United States Patent [19]

Scalzo

[11] Patent Number: 5,022,818

[45] Date of Patent: Jun. 11, 1991

[54] COMPRESSOR DIAPHRAGM ASSEMBLY

[75] Inventor: Augustine J. Scalzo, Longwood, Fla.

[73] Assignee: Westinghouse Electric Corp., Pittsburgh, Pa.

[21] Appl. No.: 312,287

[22] Filed: Feb. 21, 1989

[51] Int. Cl.[5] ..... F04D 29/54

[52] U.S. Cl. ..... 415/209.3; 415/189; 415/209.2

[58] Field of Search ..... 415/189, 190, 208.1, 415/208.2, 209.2, 209.3, 173.7

[56] References Cited

U.S. PATENT DOCUMENTS

| | | | |
|---|---|---|---|
| 2,683,583 | 7/1954 | Huebner, Jr. et al. | 415/209.3 |
| 2,917,276 | 12/1959 | Klompas et al. | 415/189 |
| 3,326,523 | 6/1967 | Bobo | 415/209.3 |
| 3,338,508 | 8/1967 | Castle et al. | 415/209.3 |
| 3,393,436 | 7/1968 | Blackhurst et al. | 415/209.3 |
| 3,997,280 | 12/1976 | Germain | 415/209.3 |
| 4,014,627 | 3/1977 | Heurteux | 415/189 |
| 4,889,470 | 12/1989 | Scalzo | 415/209.2 |

FOREIGN PATENT DOCUMENTS

| | | | |
|---|---|---|---|
| 2743291 | 10/1976 | Fed. Rep. of Germany . | |
| 1013114 | 7/1952 | France | 415/189 |
| 1523147 | 9/1966 | France . | |
| 892655 | 7/1982 | France . | |

*Primary Examiner*—John T. Kwon

[57] ABSTRACT

A compressor diaphragm assembly for combustion turbines includes a plurality of vane airfoils, each of which is formed with an integral inner shroud and an integral outer shroud, joined together by connecting bars which transfer loads between the vane airfoils and the casing slots of the turbine within which the vane airfoils are suspended.

28 Claims, 5 Drawing Sheets

COMPRESSOR DIAPHRAGM ASSEMBLY

CROSS REFERENCE TO RELATED APPLICATIONS

This application is related to a similarly-entitled application, Ser. No. 226,705, filed Aug. 1, 1988, now U.S. Pat. No. 4,889,470 by the inventor herein, assigned to the assignee of the present invention, and incorporated herein by reference.

BACKGROUND OF THE INVENTION

1. Field of the Invention

This invention relates generally to combustion or gas turbines, and more particularly to the compressor diaphragm assemblies that are typically used in such turbines.

2. Statement of the Prior Art

Over two-thirds of large, industrial combustion turbines (which are also sometimes referred to as "gas turbines") are in electric-generating use. Since they are well suited for automation and remote control, combustion turbines are primarily used by electric utility companies for peak-load duty. Where additional capacity is needed quickly, where refined fuel is available at low cost, or where the turbine exhaust energy can be utilized, however, combustion turbines are also used for base-load electric generation.

In the electric-generating environment, a typical combustion turbine is comprised generally of four basic portions: (1) an inlet portion; (2) a compressor portion; (3) a combustor portion; and (4) an exhaust portion. Air entering the combustion turbine at its inlet portion is compressed adiabatically in the compressor portion, and is mixed with a fuel and heated at a constant pressure in the combustor portion, thereafter being discharged through the exhaust portion with a resulting adiabatic expansion of the gases completing the basic combustion turbine cycle which is generally referred to as the Brayton, or Joule, cycle.

As is well known, the net output of a conventional combustion turbine is the difference between the power it produces and the power absorbed by the compressor portion. Typically, about two-thirds of combustion turbine power is used to drive its compressor portion. Overall performance of the combustion turbine is, thus, very sensitive to the efficiency of its compressor portion. In order to ensure that a highly efficient, high pressure ratio is maintained, most compressor portions are of an axial flow configuration having a rotor with a plurality of rotating blades, axially disposed along a shaft, interspersed with a plurality of inner-shrouded stationary vanes providing a diaphragm assembly with stepped labyrinth interstage seals.

A significant problem of fatigue cracking in the airfoil portion of inner-shrouded vanes exists, however, due to conventionally used methods of manufacturing such vanes. For example, in either of the rolled or forged methods used by the manufacturers of most compressor diaphragm assemblies, a welding process is used to join the vane airfoils to their respective inner and outer shrouds, such process resulting in a "heat-affected zone" at each weld joint. Crack initiation due to fatigue, it has been found, more often than not occurs at such heat-affected zones. Therefore, it would be desirable not only to provide an improved compressor diaphragm assembly that would be resistant to fatigue cracking, but also to provide a method of fabricating such assemblies that would minimize processes which produce heat-affected zones.

The problems associated with fatigue cracking are not, however, resolved merely by eliminating those manufacturing processes that produce heat-affected zones. That is, it is well known that certain forged-manufactured vane airfoils, even after having been subjected to careful stress relief which reduces the effects of their heat-affected zones, can experience a fatigue cracking problem. It is, therefore, readily apparent that not only static, but also dynamic stimuli within the combustion turbine contribute to the problem of fatigue cracking.

Forces that act upon the inner shroud and seal of a compressor diaphragm assembly are due, primarily, to seal pressure drop. Those forces, as well as aerodynamic forces acting normally and tangentially upon, and distributed over the surfaces of the vane airfoil, each contribute to the generation of other forces and moments that are transferred to the outer shroud, and subsequently to the casing of the combustion turbine via the weld joints which attach the vane airfoil to the outer shroud.

It would appear that the simple alternative of using vane airfoils with integral outer and inner shrouds would quickly solve both causes of fatigue cracking. That is, the problem of heat-affected zones would appear to be eliminated entirely while the problems associated with instabilities due to static and dynamic stimuli within the combustion turbine would appear to be minimized. Such is not the case, however.

For example, under the influence of the static forces and moments described above, the outer shroud segment of this hypothetical vane airfoil would not be stably engaged with the casing of the combustion turbine until such time that a restraining moment could be generated by contact of the extremities of the outer shroud segment with the walls of the slot formed in the casing to receive the segment. The outer shroud segment would, thus, rotate within the clearance gap (provided in the casing slot to account for thermal expansion). As a result, use of the hypothetical vane airfoil in a combustion turbine would lead to a great deal of stress in the vicinity of the outer shroud segment and excessive translational and rotational displacements, each of which would be further exacerbated under dynamic stimuli. It would also be desirable, therefore, to provide an improved compressor diaphragm assembly that would avoid the above described instabilities of engagement.

SUMMARY OF THE INVENTION

Accordingly, it is a general object of the present invention to provide an improved combustion turbine. More specifically, it is an object of the present invention to provide not only an improved compressor diaphragm assembly for use in such combustion turbines, but also an improved method of fabricating such compressor diaphragm assemblies.

It is another object of the present invention is to provide a compressor diaphragm assembly that minimizes problems of fatigue cracking.

It is still another object of the present invention is to provide a method of fabricating a compressor diaphragm assembly that substantially eliminates production of heat-affected zones.

It is a further object of the present invention to provide a compressor diaphragm assembly that minimizes its instabilities of engagement with the casing of a combustion turbine due to both static and dynamic stimuli which may be experienced within the operational combustion turbine.

It is yet a further object of the present invention to provide a compressor diaphragm assembly that is readily and inexpensively manufactured by existing technology.

Briefly, the achievement of these and other objects is accomplished in a combustion turbine which has compressor diaphragm assemblies that include a plurality of vane airfoils joined together by load transfer means as taught herein. Each of the airfoils includes an integral inner shroud and an integral outer shroud, both of which have a groove that is adapted to receive a connecting bar. The grooves of adjacent such inner and outer shrouds, together with their respective connecting bars, constitute the load transfer means. A seal carrier with a pair of disc-engaging seals is suspended from the inner shroud.

The above and other objects, advantages, and novel features according to the present invention will become more apparent from the following detailed description of a preferred embodiment thereof, considered in conjunction with the accompanying drawings wherein:

DETAILED DESCRIPTION OF THE PREFERRED EMBODIMENT

Figure 1:
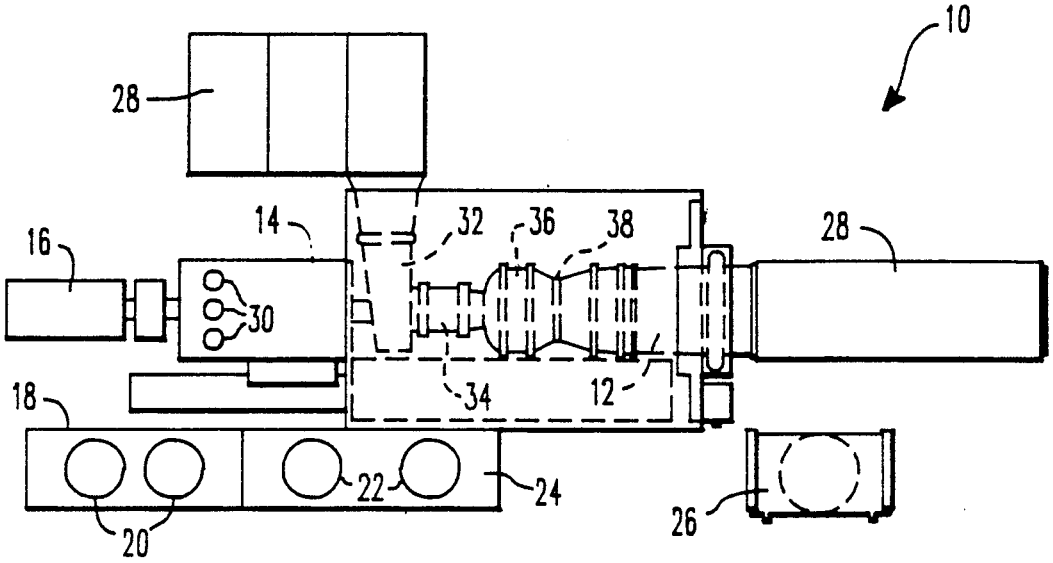
FIG. 1 is a layout of a typical electric-generating plant which utilizes a combustion turbine.

Referring now to the drawings, wherein like characters designate like or corresponding parts throughout each of the several views, there is shown in FIG. 1 the layout of a typical electric-generating plant 10 utilizing a well known combustion turbine 12 (such as the model W-501D single shaft, heavy duty combustion turbine that is manufactured by the Combustion Turbine Systems Division of Westinghouse Electric Corporation). As is conventional, the plant 10 includes a generator 14 driven by the turbine 12, a starter package 16, an electrical package 18 having a glycol cooler 20, a mechanical package 22 having an oil cooler 24, and an air cooler 26, each of which support the operating turbine 12. Conventional means 28 for silencing flow noise associated with the operating turbine 12 are provided for at the inlet duct and at the exhaust stack of the plant 10, while conventional terminal means 30 are provided at the generator 14 for conducting the generated electricity therefrom.

Figure 2:
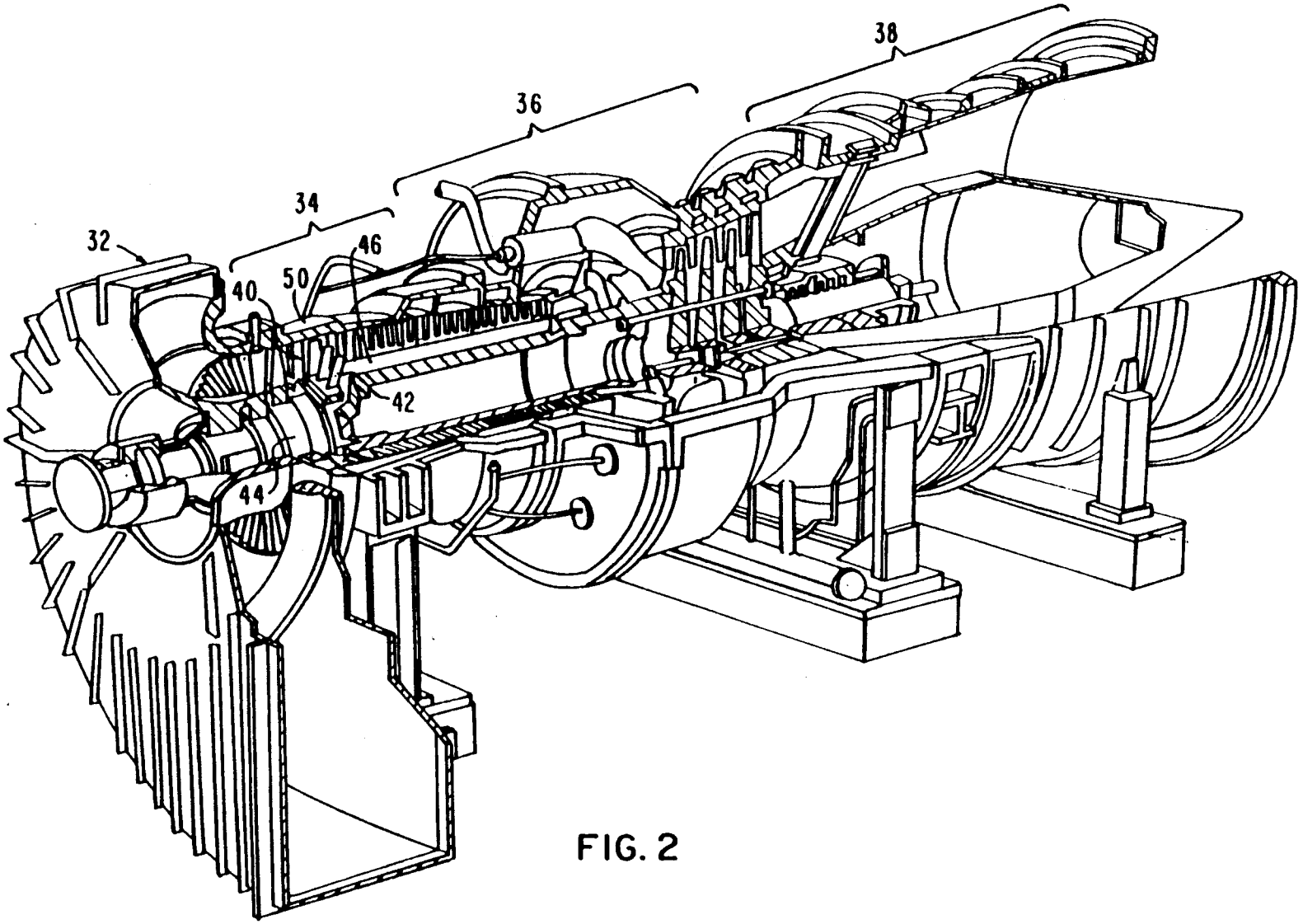
FIG. 2 is an isometric view, partly cutaway, of the combustion turbine shown in FIG. 1.

As is shown in greater detail in FIG. 2, the turbine 12 is comprised generally of an inlet portion 32, a compressor portion 34, a combustor portion 36, and an exhaust portion 38. Air entering the turbine 12 at its inlet portion 32 is compressed adiabatically in the compressor portion 34, and is mixed with a fuel and heated at a constant pressure in the combustor portion 36. The heated fuel/air gases are thereafter discharged from the combustor portion 36 through the exhaust portion 38 with a resulting adiabatic expansion of the gases completing the basic combustion turbine cycle. Such thermodynamic cycle is alternatively referred to as the Brayton, or Joule, cycle.

In order to ensure that a desirably highly efficient, high pressure ratio is maintained in the turbine 12, the compressor portion 34, like most compressor portions of conventional combustion turbines, is of an axial flow configuration having a rotor 40. The rotor 40 includes a plurality of rotating blades 42, axially disposed along a shaft 44, and a plurality of discs 46. Each adjacent pair of the plurality of rotating blades 42 is interspersed by one of a plurality of shrouded stationary vanes 48, mounted to the turbine casing 50 as explained in greater detail herein below with reference to FIGS. 3 and 4, thereby providing a diaphragm assembly in conjunction with the discs 46 with stepped labyrinth interstage seals 52.

Due to conventionally used methods of manufacturing shrouded vanes 48, there exists a significant problem of fatigue cracking. For example (and referring now more specifically to FIGS. 3 and 4), in either of the methods that have been used by the manufacturers of most compressor diaphragm assemblies, a welding process is used to join an airfoil portion 54 of the shrouded vane 48 to its respective inner shroud 56 and outer shroud 58. Such processes, as is well known, result in a heat-affected zone 60 at each weld joint 62.

As defined by the *Metals Handbook* (9th ed.), Volume 6: "Welding, Brazing, and Soldering", American Society for Metals, Metals Park, Ohio, a "heat-affected zone" is that portion of the base metal which has not been melted, but whose mechanical properties or microstructure have been altered by the heat of welding, brazing, soldering, or cutting. In stainless steels alloys of the type utilized for the airfoils 54, inner shrouds 56 and outer shrouds 58, crack initiation due to fatigue more often than not occurs at such heat-affected zones 60.

As noted above, however, problems associated with fatigue cracking are not resolved merely by eliminating those manufacturing processes that produce the heat-affected zones 60. For example, FIG. 3 illustrates an inner-shrouded vane 48 that is manufactured by the rolled constant section approach, while FIG. 4 illustrates an inner-shrouded vane 48 that is manufactured by the forged variable thickness-to-chord ratio approach.

Figure 3:
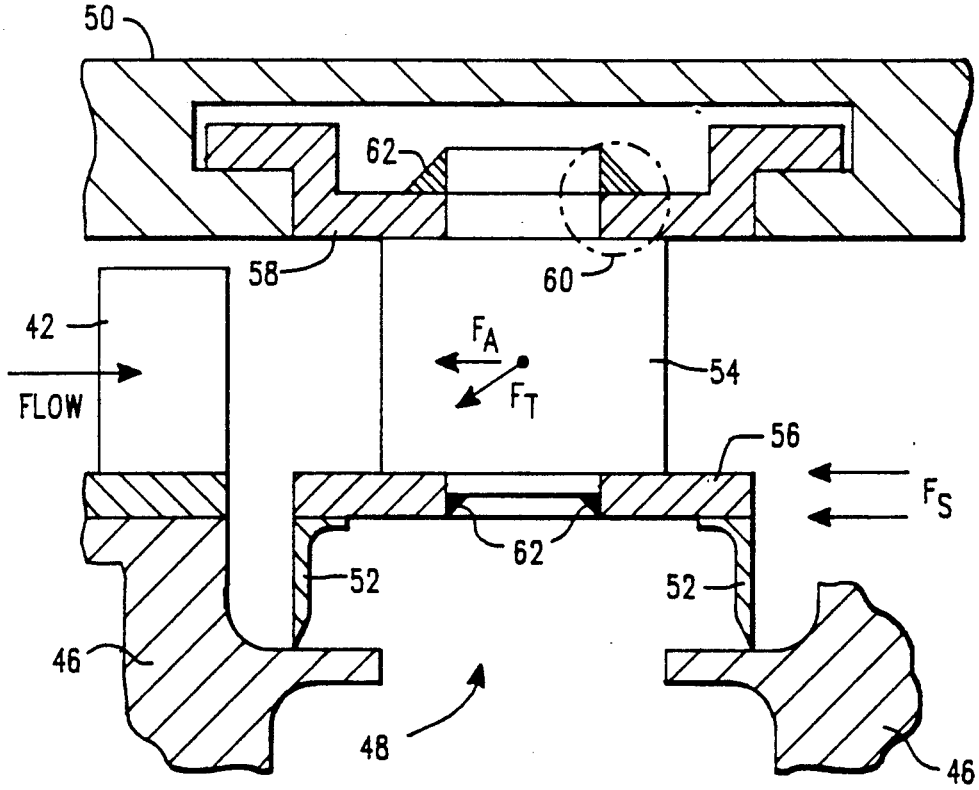
FIG. 3 illustrates the forces which impact upon a shrouded vane manufactured in accordance with one prior art method.
Figure 4:
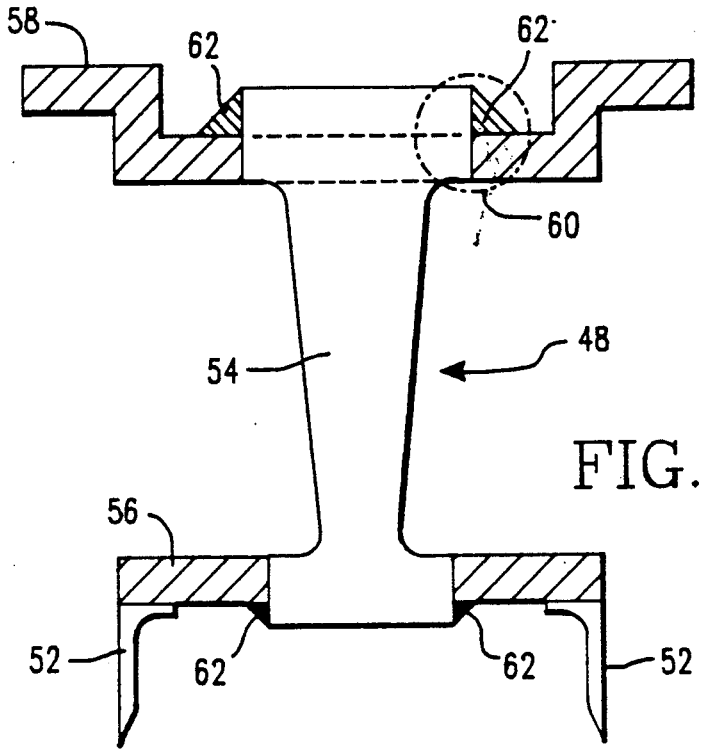
FIG. 4 shows another shrouded vane manufactured in accordance with a second prior art method.
Figure 5:
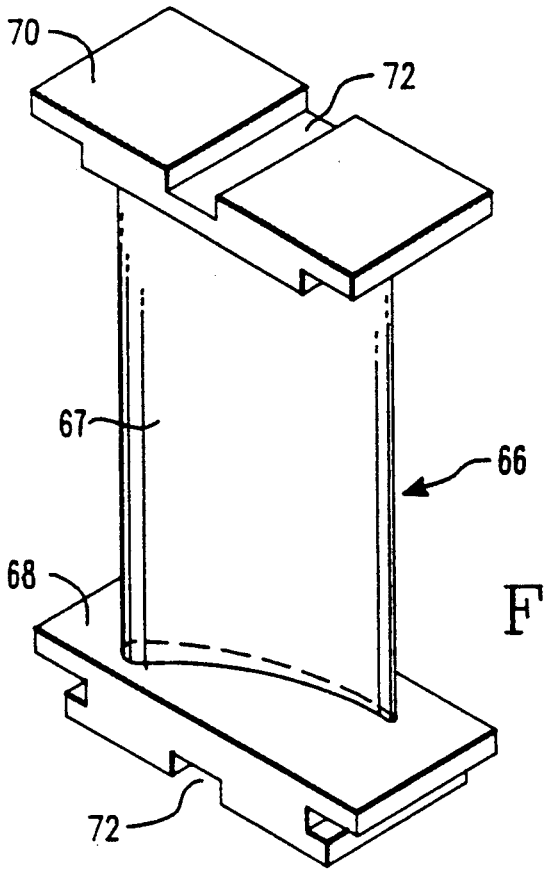
FIG. 5 is an isometric view of an integrally-shrouded vane according to the present invention.

Forces that typically act upon the inner shroud 56 and its seal 52 of conventional compressor diaphragm assemblies such as those shown in FIGS. 3 and 4 are primarily due to seal pressure drop $F_S$. Those forces, as well as aerodynamic forces acting normally $F_A$ and tangentially $F_T$ upon airfoil portion 54, each contribute to the generation of other forces and moments that are transferred to the outer shroud 58, and subsequently to the casing 50 of the combustion turbine 12 via the weld joints 62 which attach the vane airfoil 54 to the outer shroud 58.

Fatigue cracking, nevertheless, would still not be eliminated simply through the use of a hypothetical airfoil having an integrally formed inner and outer shroud, thereby doing away with the heat-affected zones 60. Under the influence of the static forces and moments described above, the outer shroud segment of this hypothetical vane airfoil would not be stably engaged with the casing of the combustion turbine until such time that a restraining moment could be generated by contact of the extremities of the outer shroud segment with the walls of the slot formed in the casing to receive the segment. The outer shroud 58 would, thus, rotate within the clearance gap (provided in the casing slot to account for thermal expansion). As a result, use of the hypothetical vane airfoil in a combustion turbine would lead to a great deal of stress in the vicinity of the outer shroud segment and excessive translational and rotational displacements, each of which would be further exacerbated under dynamic stimuli.

It has been found that one approach, as described in Ser. No. 226,705, filed Aug. 1, 1988, now U.S. Pat. No. 4,889,470, will substantially eliminate most fatigue cracking problems. Another approach that is somewhat more simple in its construction, however, is described herein.

As shown in FIGS. 5–8, the compressor diaphragm assembly 64 according to the present invention includes a plurality of vane airfoils 66, each such airfoil 66 having an integrally-formed inner shroud 68 and an integrally-formed outer shroud 70. The inner shroud 68 and outer shroud 70 of each of the airfoils 66 includes a groove 72 that is adapted to receive a connecting bar 74 to form load transfer means 76. Two or more adjacent ones of the plurality of airfoils 66 are coupled together by the load transfer means 76 and, thus, form the assembly 64.

A seal carrier 78 comprising a plurality of segments 80, is suspended from the inner shroud 68, each such seal carrier segment 80 including at least one pair of disc-engaging seals 82, and being formed to engage the inner shrouds 68 of one or more vane airfoils 66.

In accordance with one important aspect of the present invention, heat-affected zones are eliminated not only due to the plurality of vane airfoils' 66 being formed with integral inner shrouds 68 and integral outer shrouds 70, but also due to their being joined together by processes which use little or no heat at the critical airfoil to shroud junction. Furthermore, there are few if any instabilities of engagement between the vane airfoils 66 and the casing slot 75 (due either to static or dynamic stimuli) because of the load transfer means 76.

The respective integrally-formed outer shrouds 70 are joined to form an outer ring 84 with the connecting bars 74. In such a manner, each integrally-formed outer shroud 70 is also formed with a generally T-shaped cross-section for engagement with the slot 75 formed in the casing 50 of the turbine 12, held in place by conventional retaining screws 90.

Figure 6:
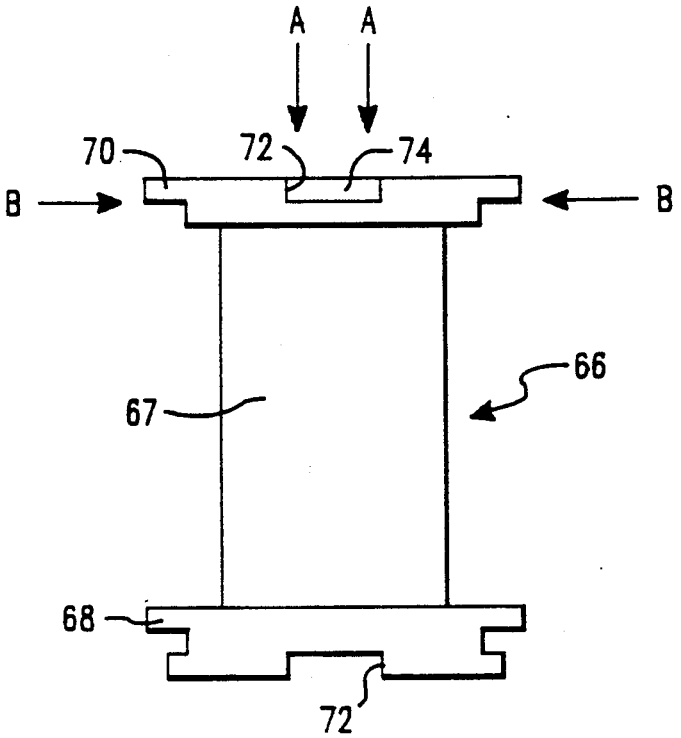
FIG. 6 shows in detail a connecting groove for the integrally-shrouded vane of FIG. 5 in accordance with one embodiment of the present invention.
Figure 7:
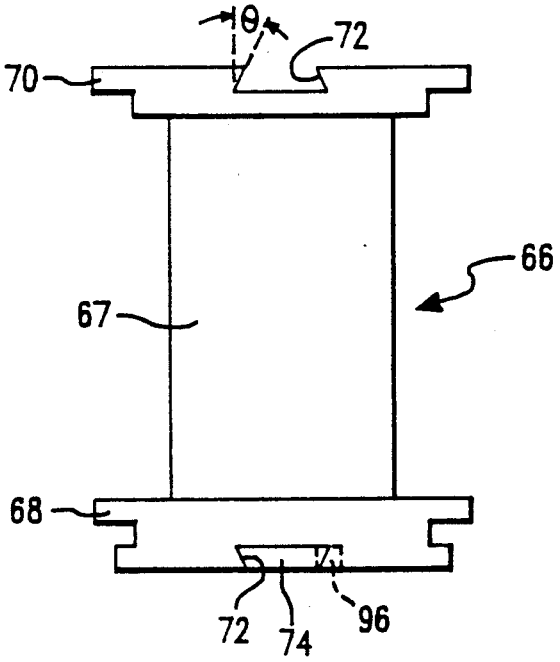
FIG. 7 shows in detail a connecting groove for the integrally-shrouded vane of FIG. 5 in accordance with another embodiment of the present invention.
Figure 8:
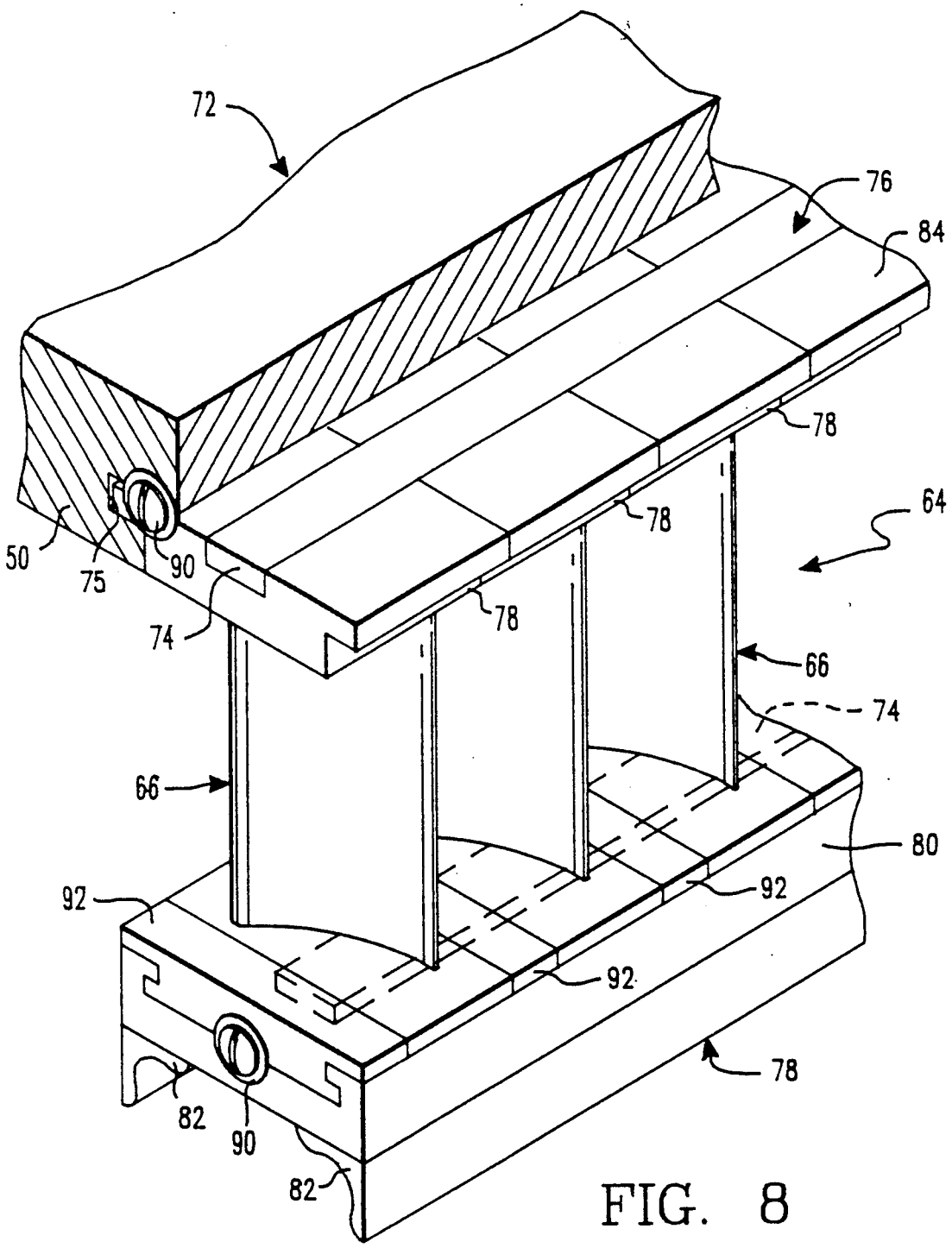
FIG. 8 depicts the inner-shrouded vane shown in FIG. 5 as assembled in accordance with a preferred embodiment of the present invention.

In order to facilitate assembly and disassembly of the compressor diaphragm according to the present invention, and to minimize the cost of producing such an assembly, spacers 92 of varying sizes are provided to properly space the vane airfoils 66 one from the other. Referring now more specifically to FIGS. 6 and 7, however, it can be seen that the integrally-formed inner shrouds 68 and outer shrouds 70 are respectively joined to adjacent ones of such integrally-formed inner shrouds 68 and outer shrouds 70 in order to prevent excessive translational and rotational displacements of the resulting compressor diaphragm assemblies 64 within the casing slots 75 of the turbine 12.

Each vane airfoil 66 is connected to an adjacent vane airfoil 66, both at the integrally-formed inner shrouds 68 and at the integrally-formed outer shrouds 70, by the load transfer means 76 comprising the connecting bars 74. The slots 72 which are provided in the integrally-formed inner shrouds 68 and at the integrally-formed outer shrouds 70 may have substantially parallel sides as shown in FIG. 6 for use with rectangular-shaped connecting bars 74. As an alternative configuration, however, the slots 72 may be tapered at an angle $\theta$ less than 90 degrees as shown in FIG. 7.

With such alternative configurations of forming the slots 72 of the integrally-formed inner shrouds 68 and the integrally-formed outer shrouds 70, compressor diaphragm assemblies 64 in accordance with the present invention may be easily formed by joining a plurality of vane airfoils 66 together, either by brazing, by electron beam welding, by laser welding (directions "A" or "B" shown in FIG. 6), byshrink fitting or simply by providing blade-type clearances (i.e., approximately 0.001 inches).

The sides of the connecting bars 74 are defined by the angle $\theta$ which can vary from zero (i.e., for parallel-sided slots 72), suitable for joining by electron beam welding in the directions A and B as shown in FIG. 6, to a taper of less than 90 degrees, suitable for shrinking or fitted assembly. For example, with the tapered slot 72 as shown in FIG. 7, the connecting bars 74 could be "shrunk" using liquid nitrogen or other suitable means and inserted within the slot 72 for expansion thereafter in the slot 72. On the other hand, the vane airfoils 64 could be heated to approximately 500° F., and the connecting bars 74 inserted therein, to provide a locked up system with low compressive and tensile stresses. Furthermore, blade type clearances could be provided between the sides of the tapered slots 72 and the connecting bars 74, with such connecting bars 74 being joined to the slots 72 by a plurality of pins 96 fitted along its length.

As explained herein above, the compressor diaphragm assembly 64 according to the present invention, thus, eliminates problems of fatigue cracking caused by heat-affected zones. This also substantially reduces stress concentrations that typically build up at the inner and outer shrouds. Integrally formed vane airfoils minimize costs associated with manufacture of such airfoils, while maximizing the quality of their production since long-established procedures that have been utilized for rotor blade manufacture (e.g., castings, forgings, contour millings, etc.) can be applied. As is readily evident, replacement of a single damaged vane airfoil 66 is easily accomplished, and the multiplicity of interfaces between the vane airfoils 66, segmented seal carrier 80, outer shrouds 70, and slot 75 provide for increased mechanical damping which will minimize dynamic response.

Obviously, many modifications and variations are possible in light of the foregoing. It is, therefore, to be understood that Within the scope of the appended claims, the invention may be practiced otherwise than as specifically described herein.

What I claim is:

1. In a combustion turbine having a casing, one or more slots of a first predetermined cross-section formed circumferentially within the casing at a compressor portion of the turbine, and a compressor diaphragm assembly adapted to be suspended from each of the one or more slots to provide a labyrinth seal with a plurality of compressor discs, a method of forming each compressor diaphragm assembly comprising the steps of:

providing a plurality of vane airfoils each of which have an integrally-formed inner shroud and an integrally-formed outer shroud, each said integrally-formed outer shroud having a complementary cross-section to the first predetermined cross-section so as to slidably engage the slots in the turbine casing;

providing load transfer means for each said vane airfoil for restraining motion; and providing carrier means for engagement with each said inner shroud, said carrier means including at least one pair of disc-engaging seals.

2. The method according to claim 1, wherein said step providing said plurality of vane airfoils, for each said vane airfoil, comprises the steps of:

providing an airfoil portion of predetermined geometry;

providing an outer shroud formed integrally with said airfoil portion at one end thereof;

providing an inner shroud formed integrally with said airfoil portion at another end thereof; and providing a lower portion of said inner shroud, remote from said airfoil portion, with means for engaging said carrier means, said engaging means having a second predetermined cross-section.

3. The method according to claim 2, wherein said step providing said carrier means further comprises the step of providing said carrier means with an upper portion having complementary cross-section to said second predetermined cross-section.

4. The method according to claim 1, wherein said step of providing load transfer means for each said vane airfoil comprises the steps of:

forming a slot in each said outer shroud;

forming a slot in each said inner shroud;

providing a plurality of connecting bars which are adapted for insertion within said slots formed in said outer shrouds and said inner shrouds; and joining adjacent ones of said outer shrouds and said inner shrouds by inserting said connecting bars within said slots.

5. The method according to claim 4, wherein said steps of forming said slots in said outer shrouds and said inner shrouds includes the step of providing parallel-sided walls.

6. The method according to claim 4, wherein said steps of forming said slots in said outer shrouds and said inner shrouds includes the step of providing tapered walls.

7. The method according to claim 4, wherein said joining step comprises the step of brazing said connecting bars to said slots.

8. The method according to claim 4, wherein said joining step comprises the step of electron beam welding said connecting bars to said slots.

9. The method according to claim 4, wherein said joining step comprises the step of laser beam welding said connecting bars to said slots.

10. The method according to claim 4, wherein said joining step comprises the step of shrink fitting said connecting bars within said slots.

11. The method according to claim 1, further comprising the steps of providing a clearance gap between each of said integrally-formed outer shrouds and said slot which said integrally-formed outer shroud slidably engages.

12. The method according to claim 11, wherein said step of providing load transfer means comprises the step of providing means for restraining motion of said integrally-formed outer shrouds within said clearance gap.

13. In a combustion turbine having a casing, a rotor including a plurality of rotating blades which are axially disposed along a shaft having a plurality of discs, and one or more slots of a first predetermined cross-section formed circumferentially within the casing at a compressor portion of the turbine, an improved compressor diaphragm assembly comprising in combination therewith:

a plurality of vane airfoils each of which have an inner shroud formed integrally therewith and an outer shroud formed integrally therewith, said outer shroud including an upper portion of complementary cross-section to the first predetermined cross-section so as to slidably engage the slots in the turbine casing;

load transfer means for connecting adjacent ones of said plurality of airfoils for restraining motion at their respective integrally-formed inner shrouds and integrally-formed outer shrouds; and carrier means for engagement with each said inner shroud, said carrier means including at least one pair of disc-engaging seals.

14. The assembly according to claim 13, wherein each said vane airfoil comprises:

an airfoil portion of predetermined geometry;

an outer shroud formed integrally with said airfoil at an upper end thereof; and an inner shroud formed integrally with said airfoil portion at a lower end thereof, a lower portion of said inner shroud, remote from said airfoil portion, including means for engaging said carrier means, said engaging means having a second predetermined cross-section.

15. The assembly according to claim 14, wherein said carrier means further comprises an upper portion having complementary cross-section to said second predetermined cross-section.

16. The assembly according to claim 13, wherein said carrier means comprises a plurality of segments.

17. The assembly according to claim 13, further comprising means for locking said integrally-formed outer shrouds within a respective slot, and means for locking said carrier means to said integrally-formed inner shrouds.

18. The assembly according to claim 13, further comprising a clearance gap between each of said integrally-formed outer shrouds and said slot which said integrally formed outer shroud slidably engages.

19. The assembly according to claim 18, wherein said load transfer means for each said airfoil comprises means for restraining motion of each of said integrally-formed outer shrouds within said clearance gap.

20. A compressor assembly, comprising:

a casing including a plurality of slots formed circumferentially therein, each said slot having a first predetermined cross-section;

a rotor including a plurality of rows of rotating blades, each said row being axially disposed along a shaft, and a plurality of discs between adjacent rows; and a plurality of rows of stationary blades each row of which intersperses adjacent rows of said rotating blades, each said row of stationary blades comprising:

a plurality of vane airfoils each of which have an inner shroud and an outer shroud formed integrally therewith, said outer shroud including an upper portion of complementary cross-section to the first predetermined cross-section so as to slidably engage the slots in the casing;

load transfer means for connecting said plurality of vane airfoils for restraining motion at their respective integrally-formed inner shrouds and integrally-formed outer shrouds; and carrier means for engagement with each said inner shroud, said carrier means including at least one pair of disc-engaging seals.

21. The assembly according to claim 20, wherein each said vane airfoil comprises:

an airfoil portion of predetermined geometry;

an outer shroud formed integrally with said airfoil portion at an upper end thereof; and an inner shroud formed integrally with said airfoil portion at a lower end thereof, a lower portion of said inner shroud, remote from said airfoil portion, including means for engaging said carrier means, said engaging means having a second predetermined cross-section;

wherein said integrally-formed outer shrouds and said integrally-formed inner shrouds each include a slot formed therein.

22. The assembly according to claim 21, wherein said carrier means further comprises an upper portion having complementary cross-section to said second predetermined cross-section.

23. The assembly according to claim 20, wherein said carrier means comprises a plurality of segments.

24. The assembly according to claim 20, further comprising means for locking said outer shrouds within a respective casing slot, and means for locking said carrier means to said inner shrouds.

25. The assembly according to claim 20, wherein said load transfer means for each said vane airfoil comprises:

a slot in each said outer shroud;

a slot in each said inner shroud; and a plurality of connecting bars, each of which is adapted for insertion within said slots formed in said outer shrouds and said inner shrouds, joining adjacent ones of said inner shrouds and said outer shrouds.

26. The assembly according to claim 25, wherein said slots in said outer shrouds and said inner shrouds each include parallel-sided walls.

27. The assembly according to claim 25, wherein said slots in said outer shrouds and said inner shrouds each include tapered walls.

28. The assembly according to claim 25, wherein each of said connecting bars connects three or more adjacent vane airfoils at their respective integrally-formed inner shrouds and integrally-formed outer shrouds.

* * * * *